US005528843A

United States Patent [19]

Rocke

[11] Patent Number: 5,528,843

[45] Date of Patent: Jun. 25, 1996

[54] CONTROL SYSTEM FOR AUTOMATICALLY CONTROLLING A WORK IMPLEMENT OF AN EARTHWORKING MACHINE TO CAPTURE MATERIAL

[75] Inventor: David J. Rocke, Eureka, Ill.

[73] Assignee: Caterpillar Inc., Peoria, Ill.

[21] Appl. No.: 292,536

[22] Filed: Aug. 18, 1994

[51] Int. Cl.[6] ..... G05D 1/02

[52] U.S. Cl. ..... 37/348; 172/2; 364/424.07

[58] Field of Search ..... 172/2, 3, 6, 7, 172/9, 4, 4.5; 364/424.07; 414/699; 37/348

[56] References Cited

U.S. PATENT DOCUMENTS

| | | | |
|---|---|---|---|
| 3,583,585 | 6/1971 | Joyce | 214/138 |
| 4,052,602 | 10/1977 | Horn et al. | 364/424.07 |
| 4,332,517 | 6/1982 | Igarashi et al. | 414/699 |
| 4,377,043 | 3/1983 | Inui et al. | 364/424.07 X |
| 4,491,918 | 1/1985 | Yuki et al. | 364/424.07 |
| 4,517,645 | 5/1985 | Yuki et al. | 364/424.07 |
| 4,742,468 | 5/1988 | Ohashi et al. | 364/424.07 |
| 4,839,835 | 6/1989 | Hagenbuch | 364/424.07 X |
| 4,910,673 | 3/1990 | Narisawa et al. | 364/424.07 |
| 4,964,779 | 10/1990 | Sagaser | 414/699 X |
| 5,002,454 | 3/1991 | Hadank et al. | 414/695.5 |
| 5,065,326 | 11/1991 | Sahm | 364/424.07 |
| 5,116,186 | 5/1992 | Hanamoto et al. | 414/694 |
| 5,128,599 | 7/1992 | Nikolaus et al. | 318/685 |
| 5,160,239 | 11/1992 | Allen et al. | 414/699 |
| 5,178,510 | 1/1993 | Hanamoto et al. | 414/694 |
| 5,182,712 | 1/1993 | Kyrtsos et al. | 364/424.07 |
| 5,218,895 | 6/1993 | Lukich et al. | 91/361 |
| 5,287,280 | 2/1994 | Yamamoto et al. | 364/424.07 |
| 5,308,219 | 5/1994 | Lee et al. | 414/699 X |
| 5,327,347 | 7/1994 | Hagenbuch | 364/424.07 |

FOREIGN PATENT DOCUMENTS

| | | |
|---|---|---|
| 6-89552 | 9/1987 | Japan . |
| 6-89553 | 9/1987 | Japan . |

OTHER PUBLICATIONS

"A Laboratory Study of Force–Cognitive Excavation", D. M. Bullock et al, Jun. 6–8, 1989, Proceedings of the Sixth International Symposium on Automation and Robotics in Construction.

"A Microcomputer–Based Agricultural Digger Control System", E. R. I. Deane et al., Dec. 20, 1988, Computers and Electronics in Agriculture (1989), Elsevier Science Publishers.

"An Intelligent Task Control System for Dynamic Mining Environments", Paul J. A. Lever et al., pp. 1–6, Presented at 1994 SME Annual Meeting, Albuquerque, New Mexico, Feb. 14–17, 1994.

"Artificial Intelligence in the Control and Operation of Construction Plant–The Autonomous Robot Excavator", D. A. Bradley et al., Automation in Construction 2 (1993), Elsevier Science Publishers B.V.

"Automated Excavator Study", James G. Cruz, A Special Research Problem Presented to the Faculty of the Construction Engineering and Management Program, Purdue University, Jul. 23, 1990.

(List continued on next page.)

*Primary Examiner*—Terry Lee Melius
*Assistant Examiner*—Victor Batson
*Attorney, Agent, or Firm*—David M. Masterson; Thomas J. Bluth; James R. Yee

[57] ABSTRACT

In one aspect of the present invention, an automatic control system for loading a bucket of a wheel loader is disclosed. The system includes a pressure sensor that produces pressure signals in response to the hydraulic pressures associated with one of the lift and tilt cylinders. A microprocessor receives the pressure signals, compares at least one of the pressure signals to a predetermined one of a plurality of pressure setpoints, and produces lift and tilt command signals in response to the pressure comparisons. Finally, an electrohydraulic system receives the lift command signals and controllably extends the lift cylinder to raise the bucket through the material, and receives the tilt command signals and controllably extends the tilt cylinder to tilt the bucket to capture the material.

7 Claims, 5 Drawing Sheets

OTHER PUBLICATIONS

"Cognitive Force Control of Excavators", P. K. Vaha et al., pp. 159–166. The Manuscript for This Paper was Submitted for Review and Possible Publication on Oct. 9, 1990. This Paper is Part of the Journal of Aerospace Engineering, vol. 6, No. 2, Apr. 1993.

"Control and Operational Strategies for Automatic Excavation" D. A. Bradley et al., Proceedings of the Sixth International Symposium on Automation and Robotics in Construction, Jun. 6–8, 1989.

"Design of Automated Loading Buckets", P. A. Mikhirev, pp. 292–298, Institute of Mining, Siberian Branch of the Academy of Sciences of the USSR, Nevosibirsk. Translated From Fiziko–Tekhnicheskie Problemy Razrabotko Poleznykh Iskopaemykh, No. 4, pp. 79–86, Jul.–Aug., 1986. Original Article Submitted Sep. 28, 1984, Plenum Publishing Corporation, 1987.

"Development of Unmanned Wheel Loader System–Application to Asphalt Mixing Plant", H. Ohshima et al., Published by Komatsu, Nov. 1992.

"Just Weigh It and See", Mike Woof, p. 27, Construction News, Sep. 9, 1993.

"Method of Dipper Filling Control for a Loading–Transporting Machine Excavating Ore in Hazardous Locations", V. L. Konyukh et al., pp. 132–183, Institute of Coal, Academy of Sciences of the USSR, Siberian Branch, Kemorovo. Translated From Fiziko–Tekhnicheskie Problemy Razrabotki Poleznykh Iskopaemykh, No. 2, pp. 67–73, Mar.–Apr., 1988. Original Article Submitted Jun. 18, 1987, Plenum Publishing Corporation, 1989.

"Motion and Path Control for Robotic Excavation", L. E. Bernold, Sep., 1990, Submitted to the ASCE Journal of Aerospace Engrg.

CONTROL SYSTEM FOR AUTOMATICALLY CONTROLLING A WORK IMPLEMENT OF AN EARTHWORKING MACHINE TO CAPTURE MATERIAL

TECHNICAL FIELD

This invention relates generally to a control system for automatically controlling a work implement of an earthworking machine and, more particularly, to a control system that controls the hydraulic cylinders of an earthworking machine to capture material.

BACKGROUND ART

Work machines such as loaders and the like are used for moving mass quantities of material. These machines have work implements consisting primarily of a bucket linkage. The work bucket linkage is controllably actuated by at least one hydraulic cylinder. An operator typically manipulates the work implement to perform a sequence of distinct functions to load the bucket.

In a typical work cycle, the operator first positions the bucket linkage at a pile of material, and lowers the bucket downward until the bucket is near the ground surface. Then the operator directs the bucket to engage the pile. The operator subsequently raises the bucket through the pile to fill the bucket, then the operator racks or tilts back the bucket to capture the material. Finally, the operator dumps the captured load to a specified dump location. The work implement is then returned to the pile to begin the work cycle again.

The earthmoving industry has an increasing desire to automate portions of the work cycle for several reasons. Unlike a human operator, an automated work machine remains consistently productive regardless of environmental conditions and prolonged work hours. The automated work machine is ideal for applications where conditions are dangerous, unsuitable or undesirable for humans. An automated machine may also enable more accurate loading making up for the lack of operator skill.

The present invention is directed to overcoming one or more of the problems as set forth above.

DISCLOSURE OF THE INVENTION

In one aspect of the present invention, an automatic control system for loading a bucket of a wheel loader is disclosed. The system includes a pressure sensor that produces pressure signals in response to the hydraulic pressures associated with one of the lift and tilt cylinders. A microprocessor receives the pressure signals, compares at least one of the pressure signals to a predetermined one of a plurality of pressure setpoints, and produces lift and tilt command signals in response to the pressure comparisons. Finally, an electrohydraulic system receives the lift command signals and controllably extends the lift cylinder to raise the bucket through the material, and receives the tilt command signals and controllably extends the tilt cylinder to tilt the bucket to capture the material.

BRIEF DESCRIPTION OF THE DRAWINGS

For a better understanding of the present invention, reference may be made to the accompanying drawings in which.

BEST MODE FOR CARRYING OUT THE INVENTION

Figure 1:
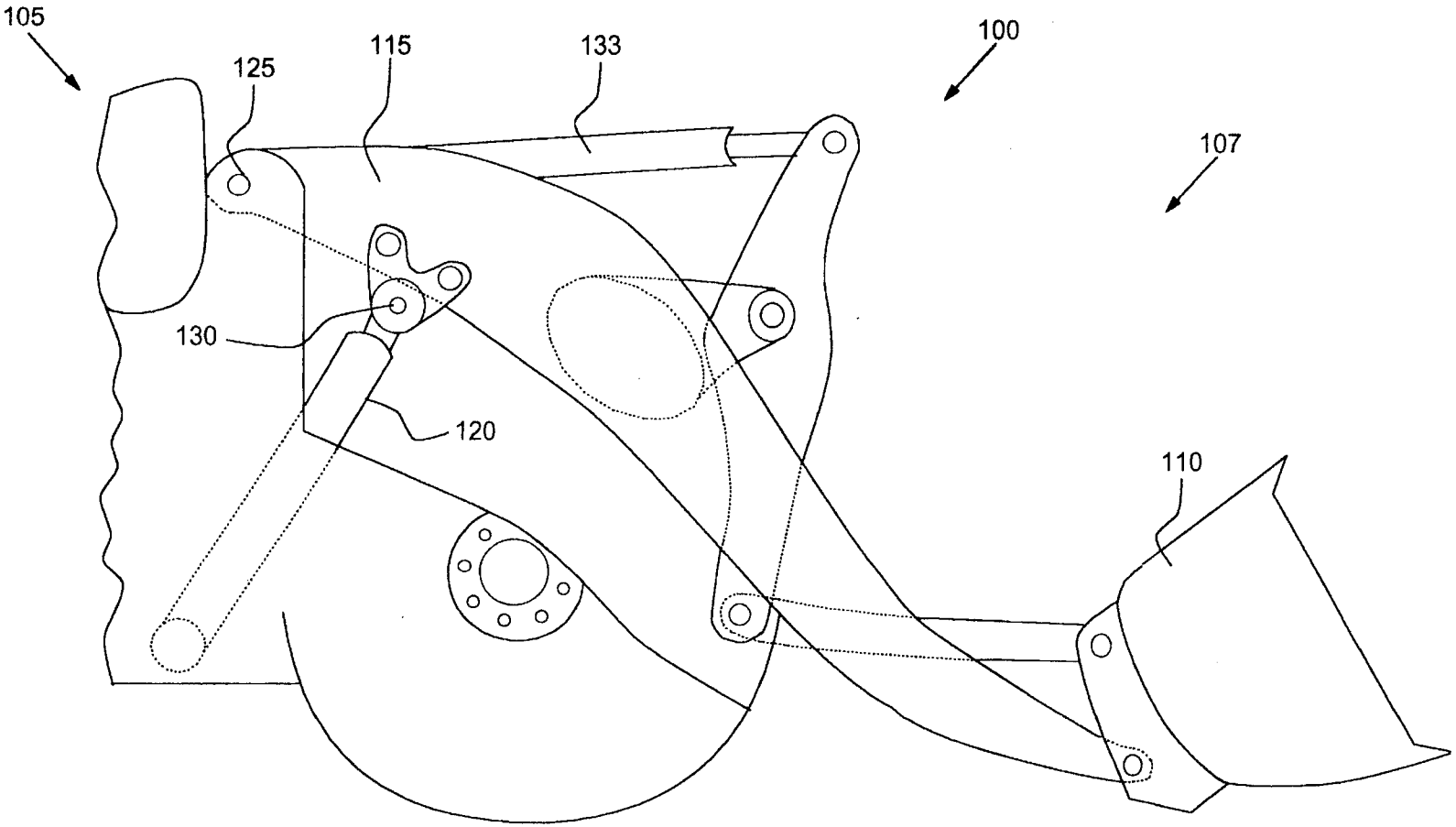
FIG. 1 shows a wheel loader and the corresponding bucket linkage.

In FIG. 1 a automatic bucket loading system is generally represented by the element number 100. Although FIG. 1 shows a forward portion of a wheel-type loader machine 105 having a work implement 107, the present invention is equally applicable to machines such as track type loaders, and other vehicles having similar loading implements. The work implement 107 includes a bucket 110 that is connected to a lift arm assembly 115, and is pivotally actuated by two hydraulic lift cylinders 120 (only one of which is shown) about a pair of lift arm pivot pins 125 (only one shown) attached to the machine frame. A pair of lift arm load bearing pivot pins 130 (only one shown) are attached to the lift arm assembly and the lift cylinders. The bucket is also tilted or racked by a bucket tilt cylinder 133.

Figure 2:
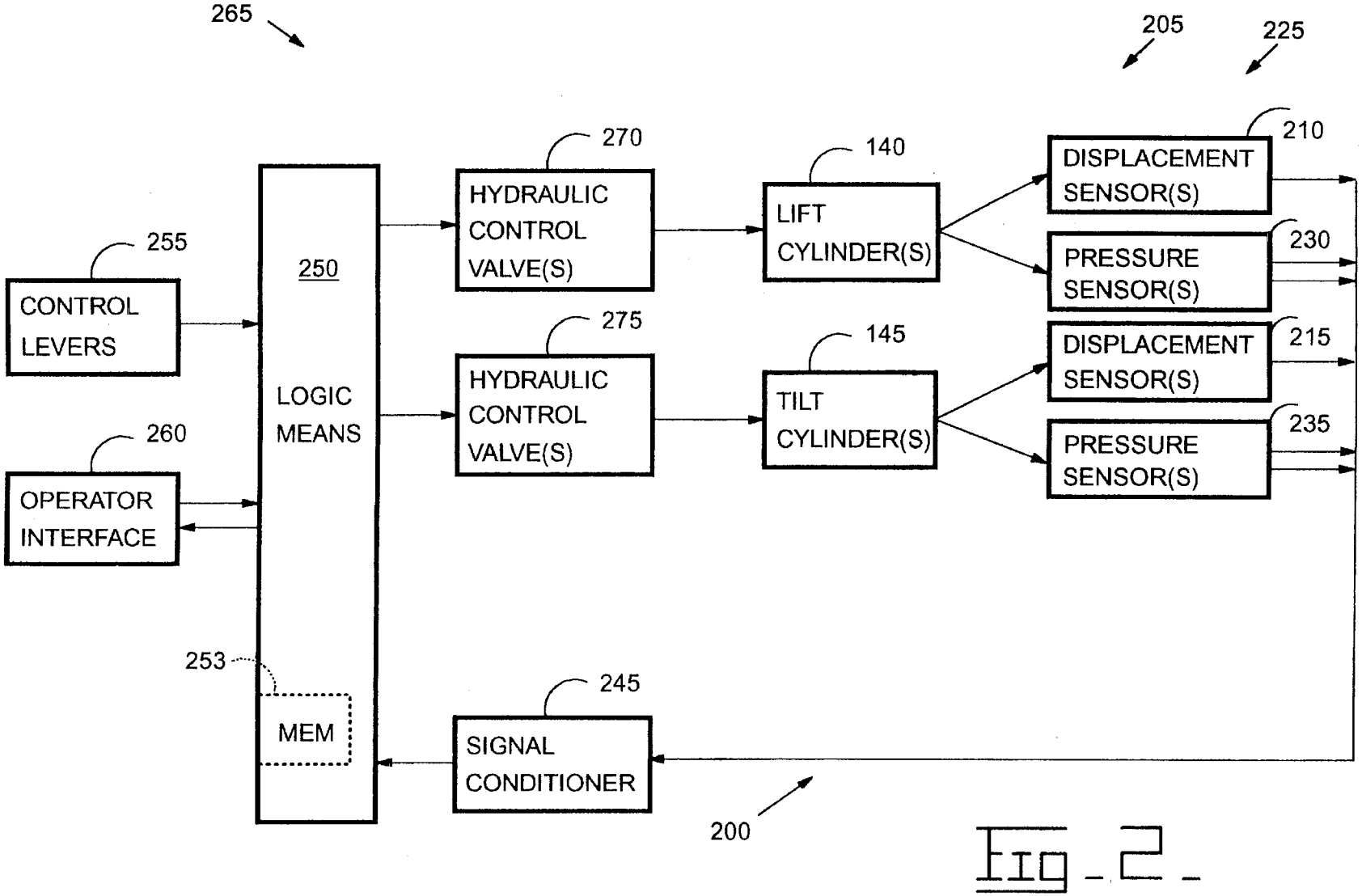
FIG. 2 shows a block diagram of an electrohydraulic system used to automatically control the bucket linkage.

Referring now to FIG. 2, a block diagram of an electrohydraulic system 200 associated with the present invention is shown. A position sensing means 205 produces position signals in response to the position of the work implement 100. The means 205 includes displacement sensors 210,215 that sense the amount of cylinder extension in the lift and tilt hydraulic cylinders respectively. A radio frequency based sensor described in U.S. Pat. No. 4,737,705 issued to Bitar et al. on Apr. 12, 1988 may be used, for example.

It is apparent that the work implement 100 position is also derivable from the work implement joint angle measurements. An alternative device for producing a work implement position signal includes rotational angle sensors such as rotatory potentiometers, for example, which measure the rotation of one of the lift arm pivot pins from which the geometry of the lift arm assembly or the extension of the lift cylinders can be derived. The work implement position may be computed from either the hydraulic cylinder extension measurements or the joint angle measurement by trigonometric methods.

A pressure sensing means 225 produces pressure signals in response to the force exerted on the work implement 100. The means 225 includes pressure sensors 230,235 which measure the hydraulic pressures in the lift and tilt hydraulic cylinders respectively. The pressure sensors 230,235 each produce signals responsive to the pressures of the respective hydraulic cylinders. For example, the cylinder pressure sensors sense the lift and tilt hydraulic cylinder head and rod end pressures, respectively. The position and pressure signals are delivered to a signal conditioner 245. The signal conditioner 245 provides conventional signal excitation and filtering. The conditioned position and pressure signals are delivered to a logic means 250. The logic means 250 is a microprocessor based system which utilizes arithmetic units to control process according to software programs. Typically, the programs are stored in read-only memory, random-access memory or the like. The programs are discussed in relation to various flowcharts.

The logic means 250 includes inputs from two other sources: multiple joystick control levers 255 and an operator interface 260. The control lever 255 provides for manual control of the work implement 100. The output of the control lever 255 determines the work implement 100 movement direction and velocity.

A machine operator may enter specifications through an operator interface 260 device. The operator interface 260 may display information relating to the machine payload. The interface 260 device may include a liquid crystal display screen with an alphanumeric key pad. A touch sensitive screen implementation is also suitable. Further, the operator interface 260 may also include a plurality of dials and/or switches for the operator to make various material condition settings.

The logic means 250 determines the work implement geometry and forces in response to the position and pressure signal information.

For example, the logic means 250 receives the pressure signals and computes lift and tilt cylinder forces, according to the following formula:

$$\text{cylinder force}=(P_2 * A_2)-(P_1 * A_1)$$

where $P_2$ and $P_1$ are respective hydraulic pressures at the head and rod ends of a particular cylinder and $A_2$ and $A_1$ are cross-sectional areas at the respective ends.

The logic means 250 produces lift and tilt cylinder command signals for delivery to an actuating means 265 which controllably moves the work implement 100. The actuating means 265 includes hydraulic control valves 270, 275 that controls the hydraulic flow to the respective lift and tilt hydraulic cylinders.

Figure 3A:
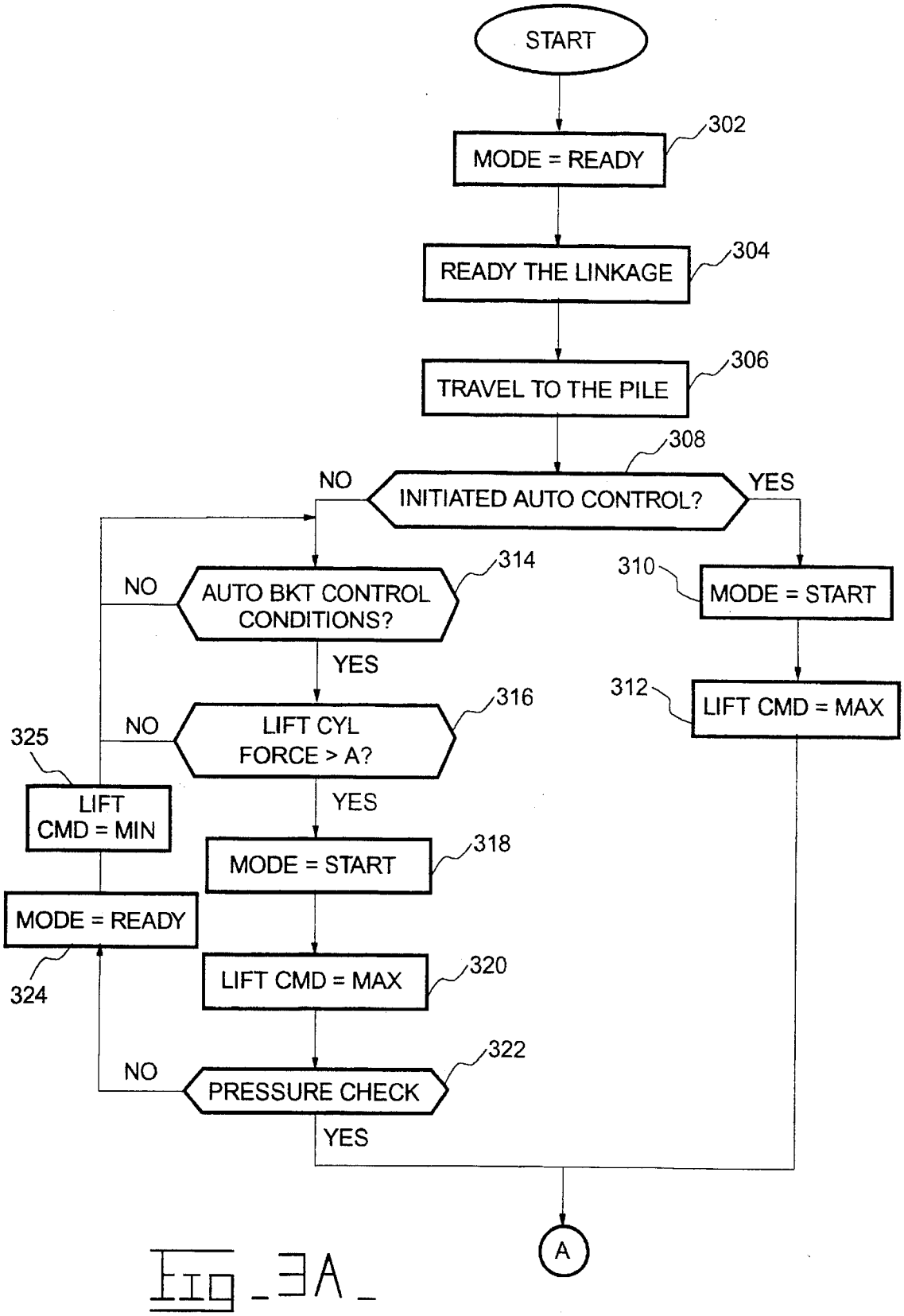
FIGS. 3A–3C are flowcharts of a program used to automatically control the bucket linkage.
Figure 3B:
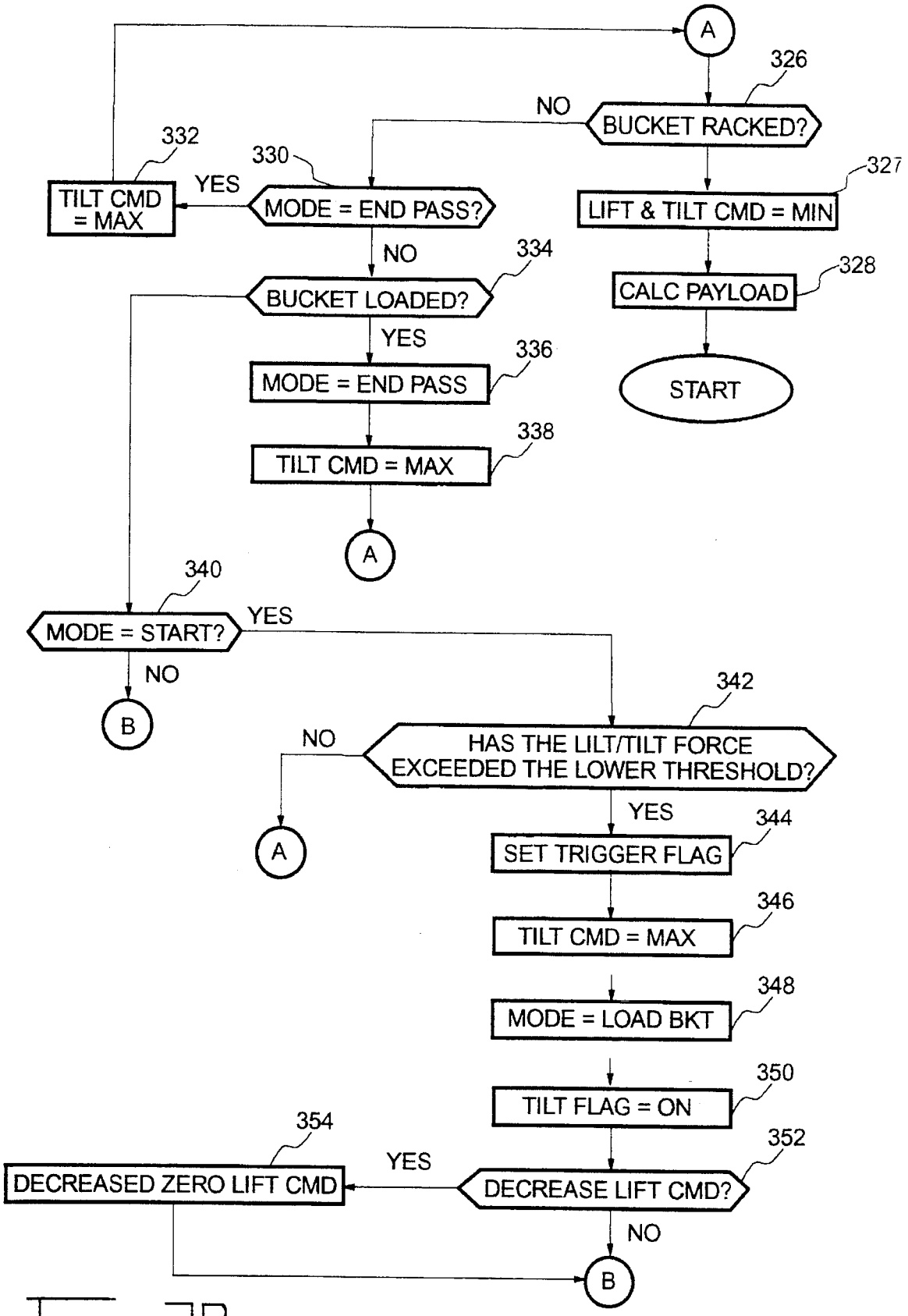
Figure 3C:
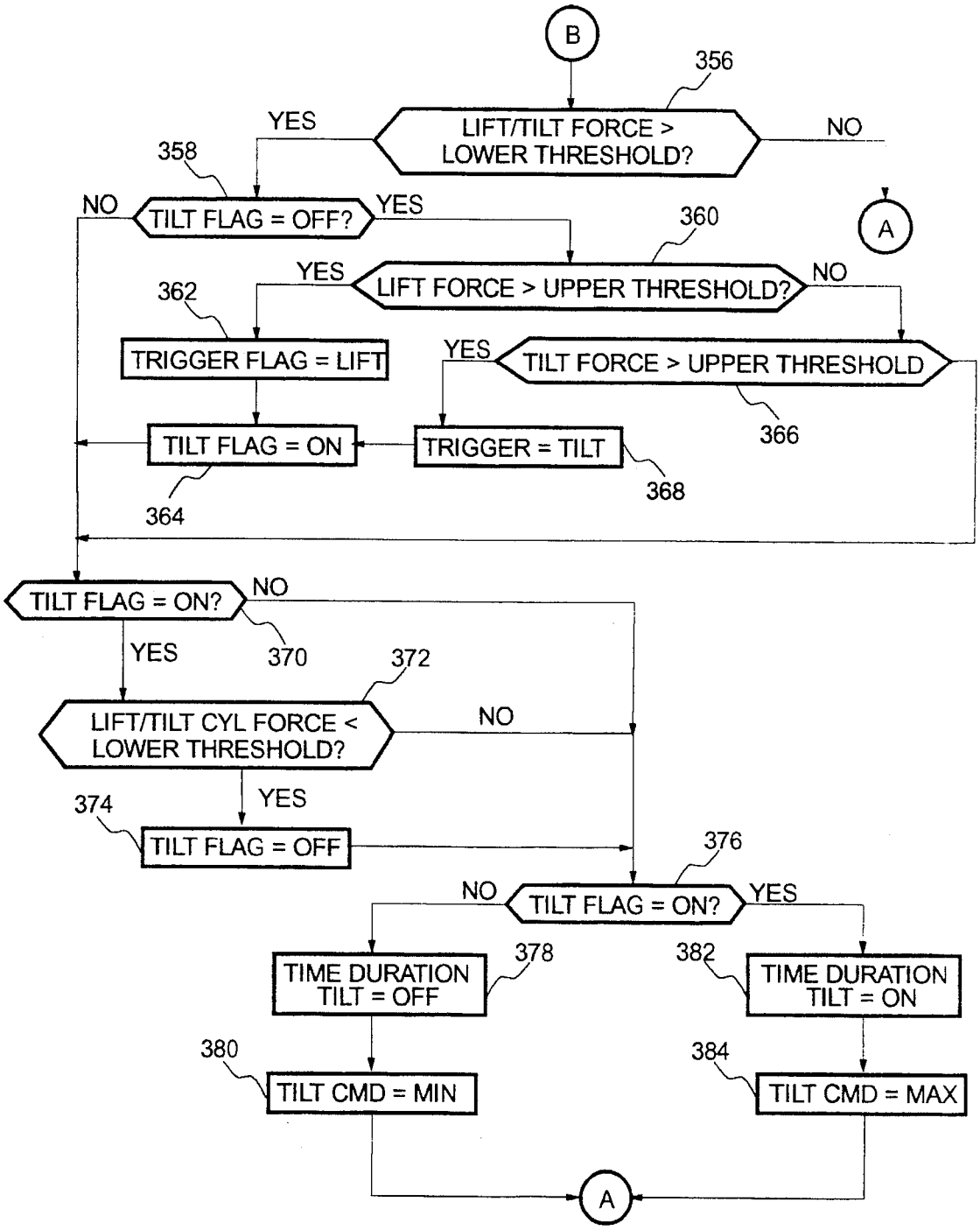

The flowcharts illustrated in FIGS. 3A–C represent computer software logic for implementing the preferred embodiment of the present invention. The program depicted on the flowcharts is adapted to be utilized by any suitable microprocessor system.

FIGS. 3A–C are flowcharts representative of computer program instructions executed by the computer-based control unit of FIG. 2 in carrying out the automated bucket loading technique of the present invention. In the description of the flowcharts, the functional explanation marked with numerals in angle brackets, <nnn>, refers to blocks bearing that number.

Referring now to FIG. 3A, the program control first determines if a variable MODE is set to READY. MODE will be set to READY in response to the operator enabling the automated bucket loading control <302>. The operator may enable the control by positioning an auto switch on the operator control panel, for example. Next, either the operator or the control system, positions the linkage to the ground and levels the bucket <304>. Accordingly, the operator directs the machine to the pile of material, preferably at full throttle <306>. The program control then determines whether the operator has initiated the automatic control of the bucket loading <308>. The operator may initiate the automatic control of the bucket loading by depressing a button in the operator cab, for example. If the operator has initiated automated bucket loading, then an audio sound is produced to alert the operator that automatic bucket loading control is controlling the lift and tilt cylinders. Additionally, MODE is set to START <310>, and the logic means produces a command signal to cause the lift cylinder to extend at maximum velocity <312>.

If the operator did not initiate automatic bucket loading, then the program control may initiate automatic bucket loading when several conditions occur <314>:

1. Is the auto switch positioned to auto control?
2. Does the lift cylinder position indicate that the bucket is within a predetermined distance of the ground?
3. Does the tilt cylinder position indicate that the floor of the bucket is substantially level?
4. Is the machine speed greater than 1 mph, but less than 6 mph?
5. Are the lift and tilt levers substantially in a centered, neutral position?
6. Does the gear shift indicate that the machine transmission is locked in first or second gear forward?

Accordingly, the program control determines whether the lift cylinder pressure/force is greater than a setpoint A <316>. If the lift cylinder force is greater than setpoint A, then the bucket is said to have engaged the pile. Consequently, an audio sound is produced, MODE is set to START <318>, and the logic means produces a command signal to cause the lift cylinder to extend at maximum velocity <320>.

The program control then determines if the tilt and lift cylinder pressures/forces remain greater than predetermined levels to insure that the bucket has engaged the pile and that the subsequent force reading was not a result of a pressure spike <322>:

1. The program control determines if the pressure/force has fallen below setpoint A at a first predetermined time period, e.g., 0.05 sec. after the auto control has started.
2. The program control determines if the pressure/force has fallen below setpoint A at a second predetermined time period, e.g., 0.20 sec. after the auto control has started.

If it is determined that the above criteria fails, a pressure spike is said to have occurred and MODE is set to READY <324>, and the logic means produces a command signal to limit the lift cylinder extension <325>.

Next, the program control determines if the position of the tilt cylinder indicates that the bucket is in a fully racked position; or if the operator has initiated manual control <326>. If one of the conditions of block 326 pass, then the automatic bucket loading is complete. Accordingly, the logic means produces a command signal to limit the extension of the lift and tilt cylinders <327>. The control additionally calculates the payload <328> in a similar manner shown in U.S. Pat. No. 4,919,222, which is herein incorporated by reference.

However, if the automatic bucket loading is not complete, then the control determines if MODE is set to END PASS <330>. If MODE is set to END PASS, then the logic means produces a command signal to cause the tilt cylinder to extend at maximum velocity <332>. However if MODE is not set to END PASS, then the program control determines if the bucket is sufficiently loaded <334>, using one of several criteria:

1. Is the extension of the tilt cylinder greater than a setpoint G, indicating that the bucket is almost completely racked back?
2. Is the extension of the lift cylinder greater than a setpoint F?
3. Has the operator initiated manual control?

If one of the above criteria occurs, then the bucket is said to be substantially filled. Program control then sets MODE to END PASS <336> while the logic means produces a command signal to cause the tilt cylinder to extend at maximum velocity <338>. Moreover, an audio signal may be produced to alert the operator that the bucket is filled.

However, if the bucket is not found to be substantially filled, then program control determines if MODE is set to START <340>. If MODE is set to START, then the control determines if the lift or tilt cylinder pressures/forces are above a lower predetermined threshold <342>. For example, 1. is the lift cylinder force is greater than a setpoint B; or 2. is the tilt cylinder force is greater than a setpoint C?

If the lift cylinder force is greater than setpoint B, then a TRIGGER FLAG is set to LIFT; whereas if the tilt cylinder force is greater than setpoint C, then the TRIGGER FLAG is set to TILT <344>. Accordingly, the logic means produces a command signal to cause the tilt cylinder to extend a predetermined velocity <346>. The program control then sets the MODE to LOAD BKT <348> and the TILT FLAG to ON <350>. The control then determines if the magnitude of the lift cylinder command signal should be decreased to a predetermined low value, e.g., zero, in response to the condition of the material <352>. The material condition may be determined in a manner similar to that set forth in Applicant's co-pending application entitled "Self-Adapting Excavation Control System and Method", filed on Mar. 23, 1994 and assigned serial number 80/217,033, which is hereby incorporated by reference. If the program control determines that the lift cylinder command signal should be decreased, then the logic means produces a command signal accordingly <354>.

The program control then determines if the lift or tilt cylinder pressures/forces have exceeded an upper predetermined threshold, for example:

1. has the lift cylinder force exceeded setpoint D; or 2. has the tilt cylinder force exceeded setpoint E <356>?

If one of the above criteria occurs, then the program control determines if the TILT FLAG has been OFF for a predetermined time period<358>. If TILT FLAG has been OFF for a predetermined time period, then the program control determines if the lift cylinder force is greater than setpoint D<360>. If true, then the program control sets the TRIGGER FLAG to LIFT <362> and the TILT FLAG to ON<364>. However, if the lift cylinder force is not greater than setpoint D, then the program control determines if the tilt cylinder force is greater than setpoint E <366>. If so, then the TRIGGER FLAG is set to TILT<368>.

If the condition of block 358 fails, then the program control determines if the TILT FLAG has been ON for a predetermined amount of time <370>. If the TILT FLAG has been ON for a predetermined amount of time, then the program control determines if:

1. the TRIGGER FLAG=LIFT and the lift cylinder force is less than a lower predetermined threshold, e.g., setpoint H; or 2. if the TRIGGER FLAG=TILT and the tilt cylinder force is less than a lower predetermined threshold, e.g., setpoint I <372>?

If the one of the above criteria occurs, then TRIGGER FLAG is set to FALSE and TILT FLAG is set to OFF <374>. Next, the program control determines if the TILT FLAG is ON. If the TILT FLAG is ON, then the program control determines the duration that the TILT FLAG has been ON <382>. Accordingly, the logic means produces a command signal to the tilt cylinder to extend at maximum velocity <384>. However, if the TILT FLAG is OFF, then the program control determines the duration that the TILT FLAG has been OFF <378>. Accordingly, the logic means produces a command signal to the tilt cylinder to limit the cylinder extension <380>.

Thus, while the present invention has been particularly shown and described with reference to the preferred embodiment above, it will be understood by those skilled in the art that various additional embodiments may be contemplated without departing from the spirit and scope of the present invention.

Industrial Applicability

The operation of the present invention is now described to illustrate the features and advantages associated with the present invention. The present invention is particularly suited to the control of earth working machines, especially those machines which perform loading functions such as excavators, backhoe loaders, and front shovels.

Once the automatic bucket control is initiated, the logic means continually monitors the force on the lift cylinder to first determine when the bucket engages the pile. Consequently, once the lift cylinder force exceeds setpoint A, the bucket is then said to have engaged the pile. Accordingly, the logic means produces a lift cylinder command signal at a maximum magnitude to cause the bucket to raise upward through the pile at maximum velocity. While the bucket is being raised through the pile, the lift and tilt cylinder forces are continually monitored. Once the lift cylinder force exceeds setpoint B or the tilt cylinder force exceeds setpoint C, the logic means produces a tilt cylinder command signal at a maximum magnitude to cause the bucket to begin racking or tilting backward to capture the material. The bucket will continue racking until one of the lift or tilt cylinder forces fall below a lower predetermined threshold, i.e., setpoints H or I, respectively. Accordingly, the logic means reduces the tilt cylinder command signal to limit the bucket racking motion. However, once one of the lift or tilt cylinder forces exceed an upper predetermined threshold, i.e., setpoints D and E respectively, the logic means increases the tilt cylinder command signal to a maximum magnitude to quickly rack the bucket. The incremental racking motion will continue, until the bucket is determined to be filled, e.g., once the tilt cylinder position exceeds setpoint F. Finally, once the tilt cylinder position is representative of a fully racked bucket, e.g., setpoint G, then the autoloading cycle is complete.

As described, the logic means varies the tilt cylinder command signal between a predetermined minimum and maximum value to maintain the lift and tilt cylinder forces at an effective force range. Accordingly the positions and forces of the lift and tilt cylinders are monitored to control the command signals at the desired magnitudes. For example, if the lift or tilt cylinder forces fall below the lower predetermined values, the extension of the tilt cylinder is halted to prevent the bucket from "breaking-out" of the pile too quickly. Alternately, if the lift or tilt cylinder force exceeds the upper predetermined value, the extension of the tilt cylinder is accelerated to prevent the bucket from penetrating too deep in the pile.

Other aspects, objects and advantages of the present invention can be obtained from a study of the drawings, the disclosure and the appended claims.

I claim:

1. A control system for automatically controlling a work implement of an earthworking machine to capture material, the work implement including a bucket, the bucket being controllably actuated by a lift hydraulic cylinder and a tilt hydraulic cylinder, comprising:

pressure sensing means for producing respective pressure signals in response to the hydraulic pressures associated with at least one of the lift and tilt cylinders;

force computing means for receiving the pressure signals and responsively computing correlative force signals;

logic means for receiving the force signals and responsively producing the tilt cylinder command signals to tilt the bucket in response to the lift cylinder force exceeding an upper pressure threshold, and producing the tilt cylinder command signals to stop the bucket tilting in response to the lift cylinder force falling below a lower pressure threshold and responsively producing lift cylinder command signals in response to comparing at least one of the pressure signals to a predetermined one of a plurality of pressure setpoints; and actuating means for receiving the lift command signals and controllably extending the lift cylinder to raise the bucket through the material, and receiving the tilt command signals and controllably extending the tilt cylinder to tilt the bucket to capture the material.

2. A control system, as set forth in claim 1, including:

means for producing respective position signals in response to the respective position of at least one of the lift and tilt cylinders; and means for receiving the position signals, comparing the position signals to a plurality of positional setpoints, and indicating when the loading is complete in response to the tilt or lift cylinder positions being greater that a respective positional setpoint.

3. A control system for automatically controlling a work implement of an earthworking machine to capture material, the work implement including a bucket, the bucket being controllably actuated by a lift hydraulic cylinder and a tilt hydraulic cylinder, comprising:

pressure sensing means for producing respective pressure signals in response to the hydraulic pressures associated with at least one of the lift and tilt cylinders;

force computing means for receiving the pressure signals and responsively computing correlative force signals;

logic means for receiving the force signals and responsively producing the tilt cylinder command signals to tilt the bucket in response to the tilt cylinder force exceeding an upper pressure threshold, and producing the tilt cylinder command signals to stop the bucket tilting in response to the tilt cylinder force falling below a lower pressure threshold and responsively producing lift cylinder command signals in response to comparing at least one of the pressure signals to a predetermined one of a plurality of pressure setpoints; and actuating means for receiving the lift command signals and controllably extending the lift cylinder to raise the bucket through the material, and receiving the tilt command signals and controllably extending the tilt cylinder to tilt the bucket to capture the material.

4. A control system, as set forth in claim 3, including:

means for producing respective position signals in response to the respective position of at least one of the lift and tilt cylinders; and means for receiving the position signals, comparing the position signals to a plurality of positional setpoints, and indicating when the loading is complete in response to the tilt or lift cylinder positions being greater that a respective positional setpoint.

5. A method for automatically controlling a work implement of an earthworking machine to capture material, the work implement including a bucket, the bucket being controllably actuated by a hydraulic lift cylinder and a hydraulic tilt cylinder, the method comprising the steps of:

producing respective pressure signals in response to the hydraulic pressures associated with at least one of the lift and tilt cylinders; and producing the tilt cylinder command signals to tilt the bucket in response to the lift cylinder pressure exceeding an upper pressure threshold; and producing the tilt cylinder command signals to stop the bucket tilting in response to the lift cylinder pressure falling below a lower pressure threshold; and comparing the pressure signals to a plurality of pressure setpoints, and producing lift cylinder command signals to raise the bucket in response to one of the lift or tilt cylinder pressures being greater than a respective predetermined setpoint.

6. A method, as set forth in claim 5, including the steps of:

producing respective position signals in response to the respective position of at least one of the lift and tilt cylinders; and receiving the position signals, comparing the position signals to a plurality of positional setpoints, and indicating when the loading is complete in response to the tilt cylinder position or lift cylinder position being greater that a respective positional setpoint.

7. A method for automatically controlling a work implement of an earthworking machine to capture material, the work implement including a bucket, the bucket being controllably actuated by a hydraulic lift cylinder and a hydraulic tilt cylinder, the method comprising the steps of:

producing respective pressure signals in response to the associated hydraulic pressures associated with at least one of the lift and tilt cylinders; and producing the tilt cylinder command signals to tilt the bucket in response to the tilt cylinder pressure exceeding an upper pressure threshold; and producing the tilt cylinder command signals to stop the bucket tilting in response to the tilt cylinder pressure falling below a lower pressure threshold; and comparing the pressure signals to a plurality of pressure setpoints, and producing lift cylinder command signals to raise the bucket in response to one of the lift or tilt cylinder pressures being greater than a respective predetermined setpoint.

* * * * *